US006345717B1

(12) United States Patent
Flewitt

(10) Patent No.: US 6,345,717 B1
(45) Date of Patent: Feb. 12, 2002

(54) REINFORCED BLISTER PACK

(75) Inventor: Harry Flewitt, Farnham (GB)

(73) Assignee: SmithKline Beecham plc (GB)

( * ) Notice: Subject to any disclaimer, the term of this patent is extended or adjusted under 35 U.S.C. 154(b) by 0 days.

(21) Appl. No.: 09/506,896

(22) Filed: Feb. 18, 2000

Related U.S. Application Data

(62) Division of application No. 09/077,693, filed as application No. PCT/EP96/05536 on Dec. 6, 1996, now abandoned.

(30) Foreign Application Priority Data

Dec. 7, 1995 (GB) ..... 9525065

(51) Int. Cl.[7] ..... B65D 83/04
(52) U.S. Cl. ..... 206/531; 206/534; 206/539
(58) Field of Search ..... 206/528, 530, 206/531, 532, 534, 538, 539

(56) References Cited

U.S. PATENT DOCUMENTS 3,054,503 A * 9/1962 Hartman, Jr. et al. ..... 206/531
3,689,458 A * 9/1972 Hellstrom ..... 206/530
3,856,144 A 12/1974 Kelly
3,921,804 A 11/1975 Tester
3,948,394 A * 4/1976 Hellstrom ..... 206/531
4,125,190 A 11/1978 Davie et al.
4,444,310 A * 4/1984 Odell ..... 206/539
4,574,954 A 3/1986 Reid
4,664,262 A 5/1987 White
4,889,236 A 12/1989 Bartell et al.
4,958,736 A 9/1990 Urheim
5,014,851 A 5/1991 Wick
5,310,060 A * 5/1994 Bitner et al. ..... 206/538
5,323,097 A 6/1994 Kalvelage
5,954,204 A * 9/1999 Grabowski ..... 206/531

FOREIGN PATENT DOCUMENTS

| | | |
|---|---|---|
| BE | 1 003 274 A | 2/1992 |
| EP | 0 146 063 A | 6/1985 |
| EP | 0 598 922 A | 6/1994 |
| FR | 1.560.988 A | 3/1969 |

* cited by examiner

*Primary Examiner*—Shian Luong
(74) *Attorney, Agent, or Firm*—Dara L. Dinner; Stephen Venetianer; Charles M. Kinzig

(57) ABSTRACT

A blister pack wherein the material between the blisters is reinforced to confer rigidity relative to flexing deformation of the blister pack. The reinforcement may take the form of a reinforcing slab or sheet, or ribs in the blister pack material. The invention facilitates handling by users with weak or deformed hands.

2 Claims, 3 Drawing Sheets

REINFORCED BLISTER PACK

CROSS REFERENCE TO RELATED APPLICATIONS

This is a division of application Ser. No. 09/077,693, filed Feb. 19, 1999, abandoned which is a national stage filing, pursuant to 35 USC 371, of PCT/EP96/05536, filed Dec. 6, 1996, and which claimed priority on the basis of British application serial number 9525065.0, filed Dec. 7, 1995.

STATEMENT REGARDING FEDERALLY SPONSORED RESEARCH OR DEVELOPMENT

Not Applicable.

REFERENCE TO A "MICROFICHE APPENDIX"

Not applicable.

BACKGROUND OF THE INVENTION

1. Field of the Invention

This invention relates to a packaging system, particularly for solid unit dosage forms such as pharmaceutical tablets, capsules, pills etc. (herein individually and collectively termed "tablets").

2. Description of the Related Art

Blister packs are commonly used for containing tablets. Blister packs generally comprise a pattern of blisters formed in a sheet of substantially impermeable deformeable plastics material, each blister defining a cavity for the containment of a tablet, the open face of the blister being closed with a film cover, usually a thin, tearable metal foil or a peel-off film. The film cover can either be easily ruptured, or the film can be easily peeled away from the blister. In use either the blister is compressibly deformed so as to force the tablet therein out though a rupturable film, or else the film is peeled off and the tablet is removed from the cavity. Generally the deformeable material is a stiff but relatively flexible material such as a pastics material or a plastics material laminate or plastics material metal foil laminate.

Known blister packs have the disadvantage that they are difficult for users with weak or deformed hands, e.g. arthritic patients to use, because the plastic material is relatively flexible and therefore difficult to exert a compressive force against and tends to deform by flexing if pressure is applied to a blister to force a tablet out through a rupturable film. Also they easily crumple, curl or fold during use and thus become of untidy appearance. It is an object of the present invention to at least partly provide a solution to these problems.

BRIEF SUMMARY OF THE INVENTION

According to the invention a blister pack is provided wherein the material between the blisters is reinforced to confer rigidity relative to flexing deformation of the blister pack.

The reinforcement according to the invention is such that the application of compressive force to a blister sufficient to force a tablet contained therein out through a rupturable film cover over the open face of the blister is insufficient to cause the material between the blisters to significantly deform.

By "significantly deform" it is understood that the pack will inevitably to some extent deform, but that the extent of deformation will be such that a user forcing a tablet out will experience sufficient rigidity of the pack to be able to force the tablet out against this rigidity, without the pack crumpling or bending by a flexing of the material between the blisters to an extent such that the blister pack crumples or bends rather than the contents of the blister being forced out. The term "flexing" herein denotes inter alia bending and folding of the pack out of the plane of the blister pack. The degree of reinforcing necessary to achieve this is determined in each case by practical considerations. Also by "significantly deform" is understood that the material between the blisters may temporarily deform elastically under the pressure applied to force the tablet out, but that the material will return substantially to its undeformed shape on release of the pressure, such that the reinforced pack does not become curled up through use. The term "rigid" herein includes more rigid against out of the plane of the slab folding and bending deformation under the application of folding or bending forces, relative to the relative flexibility of the thin sheet materials generally used for blister packs.

By means of the invention the blister pack is provided with sufficient rigidity that a user with weak or deformed hands can easily apply a compressive force to the blister against the rigidity, which is considerably easier than applying a compressive force to a blister pack made of flexible plastics material of known type, and also there will be less likelihood of the user dropping the pack during use.

In the invention the material is preferably reinforced by the combination of the blister pack, which may be a conventional known blister pack as presently widely used commercially, with a rigid support, alternatively or additionally by the introduction of structural elements such as ribs into the material between the blisters in the pack, alternatively the material between the blisters may be reinforced by a general thickening of the material to impart rigidity.

A first embodiment of the invention provides a combination of a blister pack and a substantially rigid reinforcing support for the blister pack, the support comprising a substantially planar slab of substantially rigid material having a pattern of holes passing completely through the thickness of the slab, the said holes being in a pattern corresponding to the blisters of the blister pack, the blister pack being in contact with the support such that each blister fits into a hole, each blister being accessible to a user via the hole.

In this embodiment the user can apply compressive pressure to the blister via the hole and thereby force a tablet out through a rupturable film cover over the open face of the blister. This first embodiment may also be used with blister packs having a peel off film over the open face of the blister.

In this first embodiment the support is preferably stuck to the deformeable material between the blisters, so as to prevent separation of the blister pack from the support during the application of compressive pressure to the blister. This first embodiment may also be used with blister packs having a peel off film over the open face of the blister, and by sticking of the material to the support, separation of the blister pack from the support during peeling off can be avoided. The rear face opening of the holes, i.e. on that face of the slab facing away from the film cover of the blisters, may be closed with a flexible film, e.g. to impart a neat appearance or to protect the blisters, which may be forced out by pressure on the flexible film.

A second embodiment of this invention provides a combination of a blister pack and a substantially rigid support for the blister pack, the support comprising a substantially planar slab of substantially rigid material having a pattern of holes in its surface, which pass only partly through the thickness of the slab, the said holes being in a pattern corresponding to the blisters on the blister pack, the blister pack being in contact with the holder such that each blister fits into a hole, the blister pack having a peel-off film cover over the open face of the blister.

In this second embodiment the support is preferably stuck to the deformeable material between the blisters, for the same reasons as for the first embodiment. Again, if the holes pass all the way through the slab, the rear face opening of the holes, i.e. on that face of the slab facing away from the film cover of the blisters, may be closed with a flexible film.

A third embodiment of this invention provides a combination of a blister pack and a substantially rigid support for the blister pack, the support comprising a substantially planar slab of substantially rigid material having a pattern of holes in its surface, which pass only partly through the thickness of the slab, the said holes being in a pattern corresponding to the blisters on the blister pack, the blister pack being in contact with the holder such that each blister fits into a hole, the blister pack having a rupturable film cover over the open face of the blister, the material of the slab being compressibly deformeable at least in the region of the holes, such that pressure can be applied to the slab on the reverse face to that on which the holes open, so as to thereby deform the said material and apply pressure to the blister, and so to force the tablet out through the rupturable film cover.

In this third embodiment the support is preferably stuck to the deformeable material between the blisters, for the same reasons as for the first embodiment.

The said holes may be substantially the same size and shape as the external perimeter of the blisters.

A fourth embodiment of the invention provides a combination of a blister pack and a substantially rigid reinforcing support for the blister pack, the support comprising a substantially planar slab of substantially rigid material having a pattern of holes passing completely through the thickness of the slab, the said holes being in a pattern corresponding to the blisters of the blister pack, the blister pack being in contact with the support such that each blister fits over a hole, each blister having a rupturable film cover over its open face, the film cover facing the upper surface of the slab, the slab having a thickness such that the blister may be compressibly deformed when the pack is laid upon a surface so as to force the tablet out through the film and through the hole.

By means of this embodiment the blisters may be pressed against the rigidity of the support, and the tablets forced out. The rigidity facilitates use by those with weak or deformed hands. If the slab is made thick enough the combination may be laid on a surface such as a table with the blisters uppermost, and the tablets may be forced out through the holes. The combination may then be lifted up such that the tablets are left on the surface, further facilitating access to the tablets. This may be particularly advantageous for small tablets, particularly those having a thickness less than the thickness of the slab, which are otherwise easy to drop.

There may be a further support slab having suitably positioned holes therein, to allow access to the blisters, mounted against the material of the blister pack, on the opposite surface to that on which the rupturable film is.

In this fourth embodiment the support is preferably stuck to the deformeable material between the blisters, for the same reasons as for the first embodiment.

When access to the blisters is via holes in supports as described above, the holes may be suitably shaped and/or profiled to guide the thumb or fingers of the user toward the blister. In this way use of the packaging system by those who are visually impaired may be facilitated.

The support in the first, second, third and fourth embodiments may suitably comprise a thick slab in the form of a sheet of rigid plastics material, or a rigid cellular plastics material structure, a foamed or expanded plastics material, thick or corrugated cardboard, laminates e.g of plastics sheet materials and card, or plastics sheet materials and foamed plastics etc. Other ways of making a rigid support will be apparent to those skilled in the art. The support in these embodiments of the invention may comprise a part of a package for the blister pack, e.g a box or carton in which one or more blister packs are contained.

The invention also provides a support when provided for a combination as disclosed above, and a method of construction of such a combination which comprises combining a blister pack as described with a support as described.

In a fifth embodiment of this invention the deformeable material between blisters may be rendered rigid by the formation therein of structural strengthening ribs.

Such strengthening ribs may for example be in the form of thickened areas of the said material, or corrugations therein. The ribs may be of any convenient shape, for example linear, in a grid pattern, or surrounding the blister, e.g. in the form of a ring around each blister. The ribs may project from the same face of the material as does the blister. Alternately, particularly in the case where the open face of the blister is closed by a rupturable film, the ribs may project from the face of the material which is covered with the film. In this way if the blister pack is laid flat on a surface such as a table the ribs create a space beneath the blister pack, which enable the user to compressibly deform the blister against its rigidity and force a tablet through the film and out of the blister. If the said space is wide enough the tablet can thereby be pressed out onto the surface, so as to be left there when the deformed pack is lifted away.

In this way use of the pack by those with weak or deformed hands is facilitated. Also the ribs in the material may be so shaped or aligned etc. to guide the thumb or fingers of the user toward the blister, and may be combined with for example Braille symbols embossed on the material. In this way use of the blister pack by the visually impaired is facilitated.

When in this invention the material between the blisters is reinforced by a general thickening of the material to impart rigidity, the material between the blisters may be the same material as is normally used for making blister packs, e.g. a flexible plastics material, but made thicker, e.g. 50% thicker or twice as thick as is conventionally used. This method is not preferred however as it can result in blisters which are difficult to deform by pressure, or alternatively require areas of thinner material to be used at places where there are blisters. Also the materials from which blister packs are made can be quite expensive, e.g. needing to provide protection against moisture and air etc. over a long storage period, whereas the materials used for the above described supports can be very cheap.

The blister pack incorporated in the combination packaging system of this invention may be of generally conventional construction. The blisters may be any convenient shape and size to suit the tablets for which they are to be used, as conventional. The packaging system of the invention is suitable for use with all kinds of tablets, and may for example be used with the tablets disclosed in EP 0055009A which are specifically intended for use by patients with weak or deformed hands, because such tablets tend to come to rest in a tilted position, relatively easy to grasp.

The support and blister pack discussed above may be of any convenient shape, but a preferred shape is rectangular, so as to enable the combination of support and blister pack to be conveniently contained in a box. Alternatively for example the support and blister pack may be circular, or of other shapes.

The blister pack of the invention, and the reinforcing slab may be made out of entirely conventional materials and by entirely conventional processes.

BRIEF DESCRIPTION OF THE SEVERAL VIEWS OF THE DRAWINGS

The invention will now be described by way of example only with reference to the accompanying drawings.

DETAILED DESCRIPTION OF THE INVENTION

Figure 1:
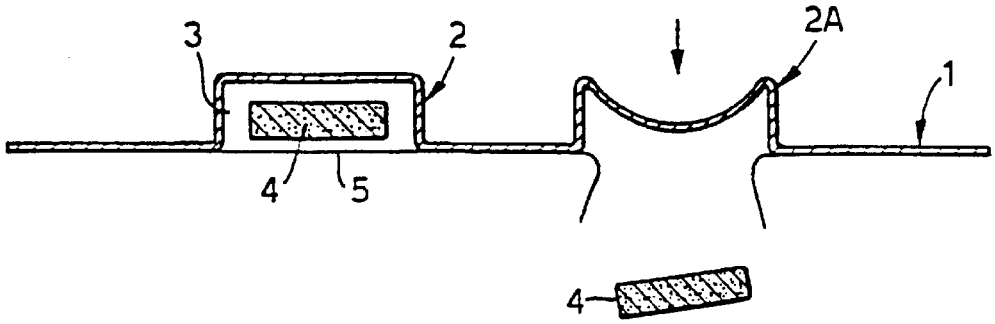
Fig.1. (PRIOR ART)
FIG. 1 shows the construction of a conventional blister pack, in cross section

Referring to FIG. 1, a conventional blister pack comprises a sheet of substantially impermeable plastics material 1 in which are formed blisters 2, each blister 2 defining a cavity 3 for the containment of a tablet 4 therein. The open face of the cavity 3 is closed by a rupturable metal foil cover 5, thin enough that when the blister 2 is deformed by compressive pressure as at blister 2A the tablet 4 can be forced out for use through the foil cover 5 as this tears.

Figure 2:
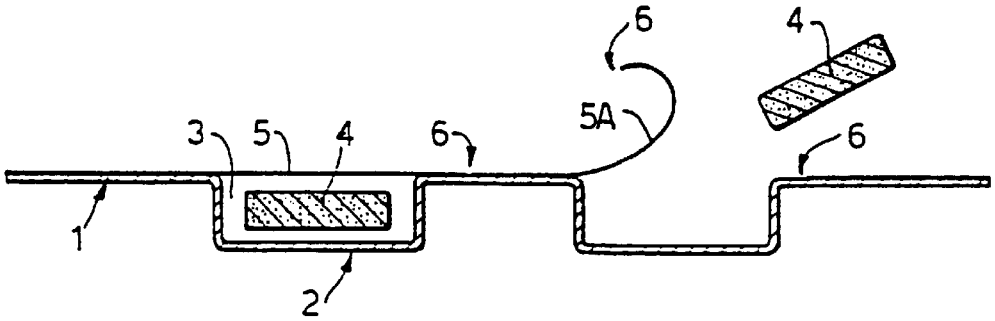
Fig.2. (PRIOR ART)
FIG. 2 shows the construction of another type of conventional blister pack, in section

Referring to FIG. 2, another type of conventional blister pack is shown, in which parts corresponding to FIG. 1 are numbered correspondingly. In the blister pack of FIG. 2 the film 5 is a film which can be easily peeled away from the sheet 1. as shown at 5A, to allow the tablet 4 to be removed for use. The film 5 is divided by cuts at points 6 to allow a small patch of the film 5 to be peeled off as shown at 5A to open a single cavity, to enable the tablet 4 to be removed.

Figure 3:
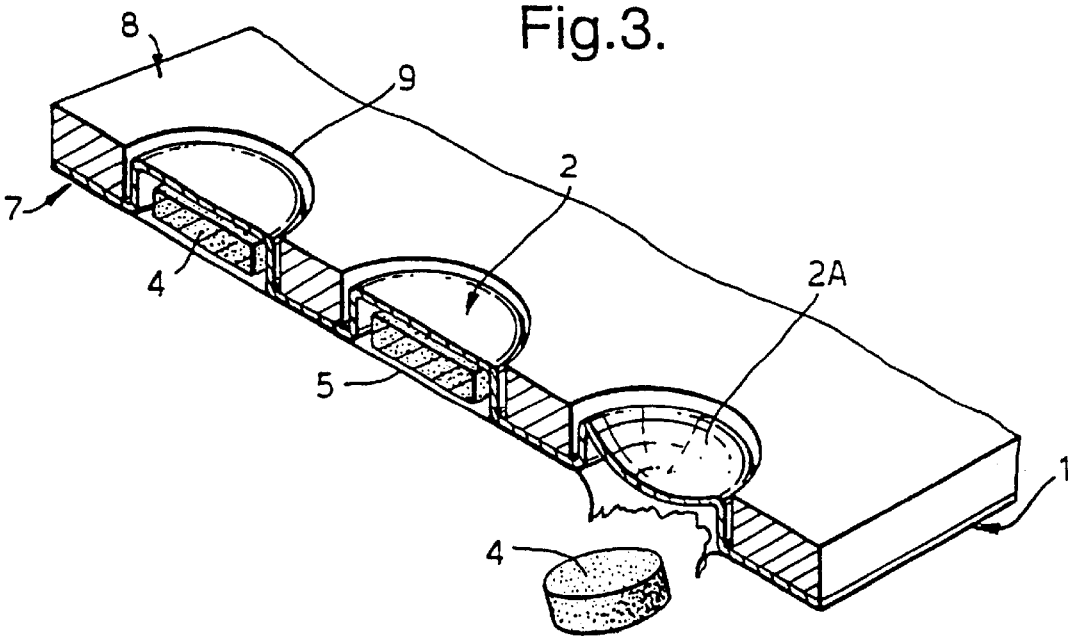
FIG. 3 shows part of a packaging system of the first embodiment of this invention in a perspective sectional view

Referring to FIG. 3 a combination of a blister pack 7 and a substantially rigid support 8 is shown. The blister pack 7 may be either of the type shown in FIG. 1 or FIG. 2. The support 8 comprises a substantially planar slab made for example of corrugated cardboard, expanded polystyrene or a plastic material cellular structure etc. Passing completely through the thickness of the slab 8 is a pattern of holes 9, the pattern of the holes 9 corresponding to the pattern of the blisters 2 in the blister pack 7, such that when the plastic material 1 of the blister pack 7 is in contact with the slab 8, each blister 2 fits into a hole 9. The material 1 is stuck to the surface of the slab 8 by means of a suitable adhesive (not shown). As the holes 9 pass completely through the slab 8, the blisters 2 are accessible via the hole 9 in which they fit.

The combination can be used in two ways depending upon whether the blister pack is of the type shown in FIG. 1 or FIG. 2. If as shown in FIG. 1, which is illustrated in FIG. 3, compressive pressure can be applied to the blister as shown by the arrow in FIG. 3 to deform the blister 2A as shown and force the tablet 4 out through the foil 5. The substantially rigid slab 8 prevents the blister pack 7 from crumpling during use and adopting an untidy appearance.

If the blister pack is as shown in FIG. 2, then film may be simply peeled back as shown in FIG. 2 with the blister pack 7 in-situ in the slab 8. The slab 8 again eases this operation for users with weak or deformed hands, and prevents the blister pack 6 from crumpling during use.

Figure 4:
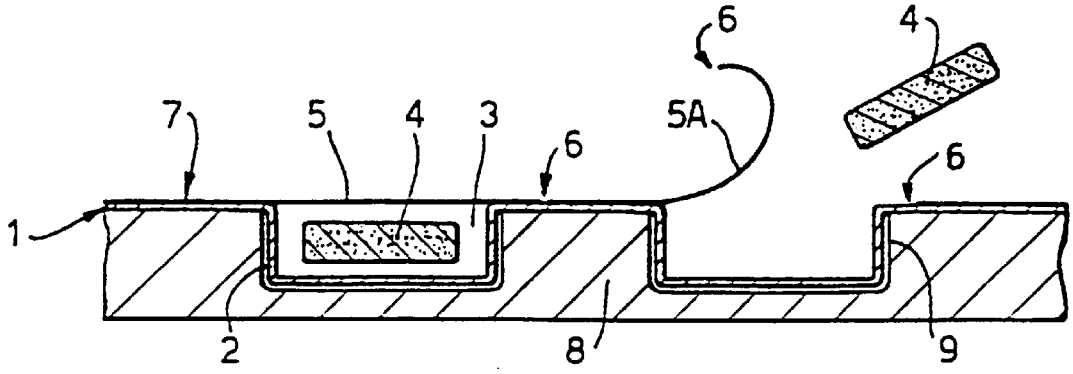
FIG. 4 shows a packaging system of the second embodiment of this invention, in section

Referring to FIG. 4 a combination of a blister pack 7 and a substantially rigid slab 8 is shown, generally similar in construction to that of FIG. 3, except that holes 9 do not pass completely through the slab 8, but only part way through, so as to form cavities in which the blisters 2 fit. In this combination the blister pack 7 is of the type shown in FIG. 2. The plastics material 1 between the blisters 2 is again stuck to the slab 8, and the film 5 can be peeled off as shown to allow removal of the tablet 4.

The slab 8 again eases the use of the blister pack by those with weak or deformed hands.

Figure 5:
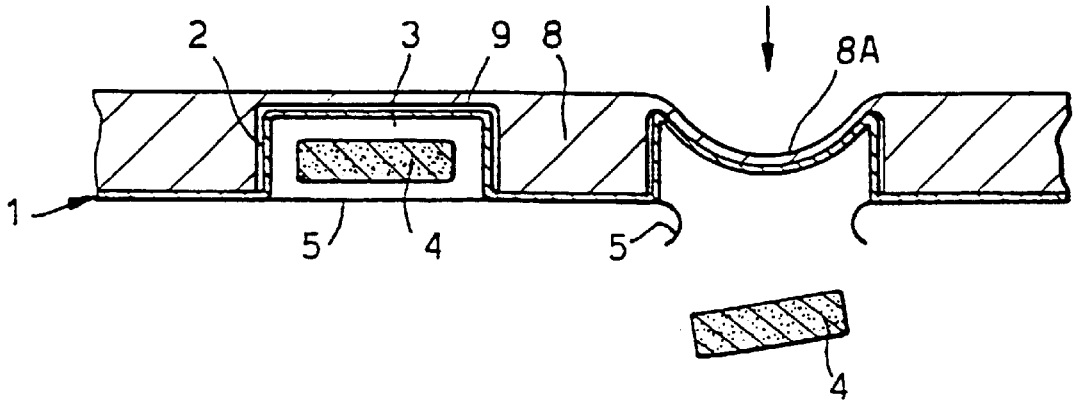
FIG. 5 shows a packaging system of the third embodiment of this invention, in section

Referring to FIG. 5 a combination of a blister pack 7 and a substantially rigid slab 8 is shown, generally similar in construction to that of FIG. 4, such that holes 9 do not pass completely through the slab 8, but only part way through, so as to form cavities in which the blisters 2 fit. In this combination the blister pack 7 is of the type shown in FIG. 1. The plastics material 1 between the blisters 2 is again stuck to the slab 8. The material of the slab 8 is compressibly deformeable at least in the region of the holes 9, i.e. at points 8A such that pressure can be applied to the slab 9 in this region on the reverse face to that on which the holes 9 open, i.e. at the point shown by the arrow in FIG. 5, so as to thereby deform the said material and force the tablet 4 out through the rupturable film cover 5.

The slab 8 again eases the use of the blister pack by those with weak or deformed hands.

Figure 6:
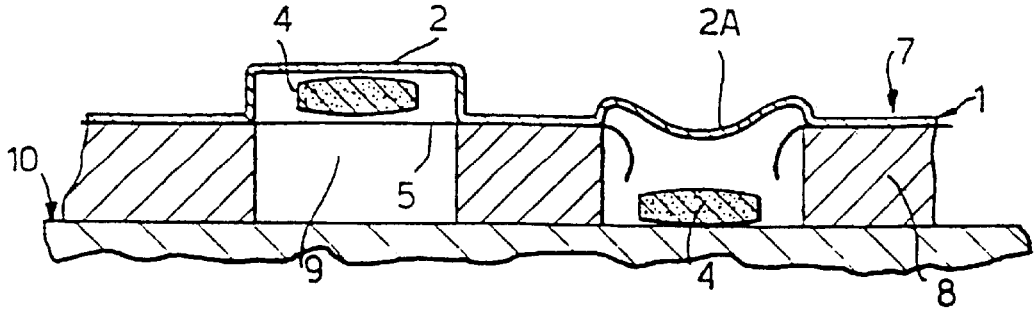
FIG. 6 shows a packaging system of the fourth embodiment of this invention, in section FIGS. *7a–c* shows two types of packaging systems of the fifth embodiment of this invention in part-sectioned perspective view.

Referring to FIG. 6 a combination of a blister pack 7 and a substantially rigid reinforcing support for the blister pack is shown. The support comprises a substantially planar slab 8 of substantially rigid material having a pattern of holes 9 passing completely through the thickness of the slab 8. The holes 9 are in a pattern corresponding to the blisters 2 of the blister pack 7, the blister pack 7 being in contact with the support 8 such that each blister 2 fits over a hole 9. Each blister 2 has a rupturable film cover 5 over its open face, the film 5 cover facing the upper surface of the slab 8. The slab 8 has a thickness such that the blister 2 may be compressibly deformed, as shown at 2A, so as to force the tablet 4 out through the film 5 and through the hole 9.

By means of this embodiment the blisters 2 may be pressed against the rigidity of the support 8, and the tablets 4 forced out. The slab is made thick enough as shown in FIG. 6 the combination may be laid on a surface 10 such as a table with the blisters 2 uppermost, and the tablets may be forced out through the holes 9 to fall onto the surface 10. The combination may then be lifted up such that the tablets 4 are left on the surface 10, further facilitating access to the tablets.

A further support slab 8A having suitably positioned holes 9A therein, to allow access to the blisters 2, may be mounted against the material of the blister pack 1, on the opposite surface to that on which the rupturable film 5 is.

Figure 7A:
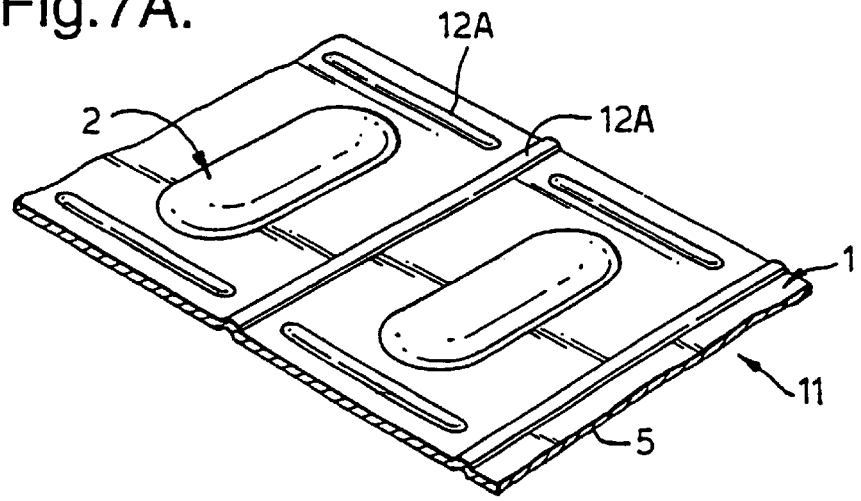
Figure 7B:
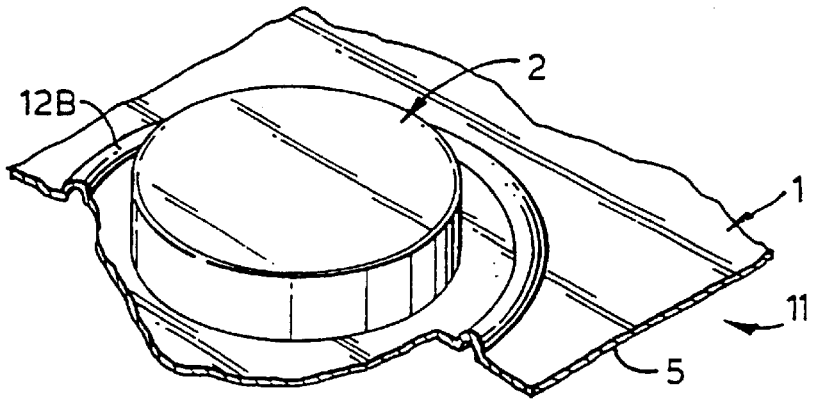
Figure 7C:
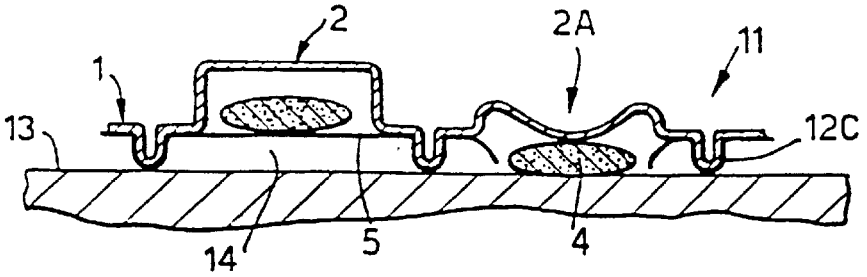

Referring to FIGS. 7A, 7B and 7C, three blister packs 11 (generally) are shown, in which the plastics material 1 between blisters 2 is rendered rigid by the formation therein of reinforcing ribs 12A, 12B, 12C, bulging out of the plastics material 1. In FIGS. 7A and 7B the ribs 12A, 12B bulge out in the same direction as the blisters 2, and in FIG. 7C they bulge out in the opposite direction. In FIG. 6A the blisters 2 are generally lozenge shaped, in FIG. 6B the blister 2 is circular. In FIG. 6A ribs 12A are linear structures, disposed between the blisters 2 in a grid fashion. In FIG. 6B the rib 12B is formed as a ring around the blisters 2.

In each case the ribs 12A, 12B, 12C render the blister pack 11 sufficiently rigid that when the blister pack is of the type shown in FIG. 1, compressive pressure is applied to a blister 2 so as to force a tablet 4 (not shown in FIG. 6) out through the film cover 5 the blister pack 10 does not significantly deform. The blister pack 11 could alternatively have a film cover 5 which can be peeled off in the general manner shown in FIG. 2. This reinforcement eases the use of the blister pack 11 by those with weak or deformed hands.

In FIG. 7C the ribs 12C enable the blister pack 11 to be placed upon a surface 13, with a space 14 thereby formed beneath the pack 11. The blister 2 can be compressibly deformed as shown at 2A so as to force the tablet 4 out through the foil cover 5 onto the surface 13. The blister pack 11 may then be lifted from the surface 13 to leave the tablet 4 thereon.

What is claimed is:

1. A blister pack comprising a blister sheet of plastics material having a substantially planar part and the remainder of which is in the form of a plurality of blisters disposed in a pattern, the blisters projecting out of said substantially planar part and forming pockets, each pocket being of a size to contain only a single tablet, and a covering film closing the interior of each blister, wherein the substantially planar part of the plastics material is rendered rigid by structural strengthening ribs formed therein, each blister being substantially surrounded by, but spaced from, a reinforcement comprising at least one of said structural strengthening ribs, the reinforcement surrounding each blister being disposed so that any straight line lying in said planar part and intersecting a blister also intersects at least one said rib of the reinforcement surrounding the intersected blister, whereby, when compressive pressure is applied to a blister so as to force a tablet out through the covering film by rupturing the covering film, the blister pack does not significantly deform, in which the structural strengthening ribs are constituted by linear bulging portions of the plastics material disposed in a grid wherein each blister is located between a first pair of parallel strengthening ribs and between a second pair of parallel strengthening ribs, the ribs of the second pair being perpendicular to, and extending past, ends of the ribs of the first pair.

2. A blister pack comprising a blister sheet of plastics material having a substantially planar part and the remainder of which is in the form of a plurality of blisters disposed in a pattern, the blisters projecting out of said substantially planar part and forming pockets, each pocket being of a size to contain only a single tablet, and a covering film closing the interior of each blister, wherein the substantially planar part of the plastics material is rendered rigid by structural strengthening ribs formed therein, each blister being substantially surrounded by, but spaced from, a reinforcement comprising at least one of said structural strengthening ribs, the reinforcement surrounding each blister being disposed so that any straight line lying in said planar part and intersecting a blister also intersects at least one said rib of the reinforcement surrounding the intersected blister, whereby, when compressive pressure is applied to a blister so as to force a tablet out through the covering film by rupturing the covering film, the blister pack does not significantly deform, in which the blisters project out of said substantially planar part, in the same direction, on one side thereof, in which the covering film is rupturable, and in which the structural strengthening ribs are constituted by portions of the plastics material bulging out of the substantially planar part on the side opposite said one side thereof, whereby a tablet can be removed from a blister by placing the blister pack on a supporting surface with the ribs on said opposite side in contact with the supporting surface, and pressing manually on a blister.

* * * * *